US007314992B2

(12) United States Patent
Funaki et al.

(10) Patent No.: US 7,314,992 B2
(45) Date of Patent: Jan. 1, 2008

(54) APPARATUS FOR ANALYZING MUSIC DATA AND DISPLAYING MUSIC SCORE

(75) Inventors: Tomoyuki Funaki, Hamamatsu (JP); Kanami Hoshika, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/388,751

(22) Filed: Mar. 24, 2006

(65) Prior Publication Data

US 2006/0219089 A1 Oct. 5, 2006

(30) Foreign Application Priority Data

Mar. 24, 2005 (JP) ..... 2005-086812

(51) Int. Cl.
*G10H 1/40* (2006.01)

(52) U.S. Cl. ..... 84/611

(58) Field of Classification Search ..... 84/611, 84/635, 651, 667

See application file for complete search history.

(56) References Cited

U.S. PATENT DOCUMENTS 4,476,767 A * 10/1984 Katsuoka ..... 84/115

6,235,979 B1 5/2001 Yanase

FOREIGN PATENT DOCUMENTS

JP 11-327427 A 11/1999

* cited by examiner

*Primary Examiner*—Lincoln Donovan
*Assistant Examiner*—Andrew Millikin
(74) *Attorney, Agent, or Firm*—Rossi, Kimms & McDowell LLP

(57) ABSTRACT

An apparatus is to analyze music data of a musical performance including note events of triplets as well as note events like triplets, and to display the note events in triplet notation properly in view of the general rhythmic tendency of the musical performance. Music data representing a musical performance is analyzed by counting the number of note events which occur as a regular rhythm pattern and the number of note events which occur as a triplet, so that the performed music as a whole is judged to be either in a triplet-shy rhythm or in a triplet-rich rhythm. Then fuzzy triplet detecting time windows detect triplet candidate notes. Thus detected fuzzy triplet note events are flexibly decided to be notated in a regular rhythm pattern form or in a triplet form depending on whether the performed music as a whole is in a triplet-shy rhythm or in a triplet-rich rhythm. The notes are displayed in the decided form of notation to provide a good-looking and easily understandable music score.

5 Claims, 13 Drawing Sheets

Processing for Judging Overall Rhythm of Music Piece (Part 1)

Processing for Judging Overall Rhythm of Music Piece (Part 2)

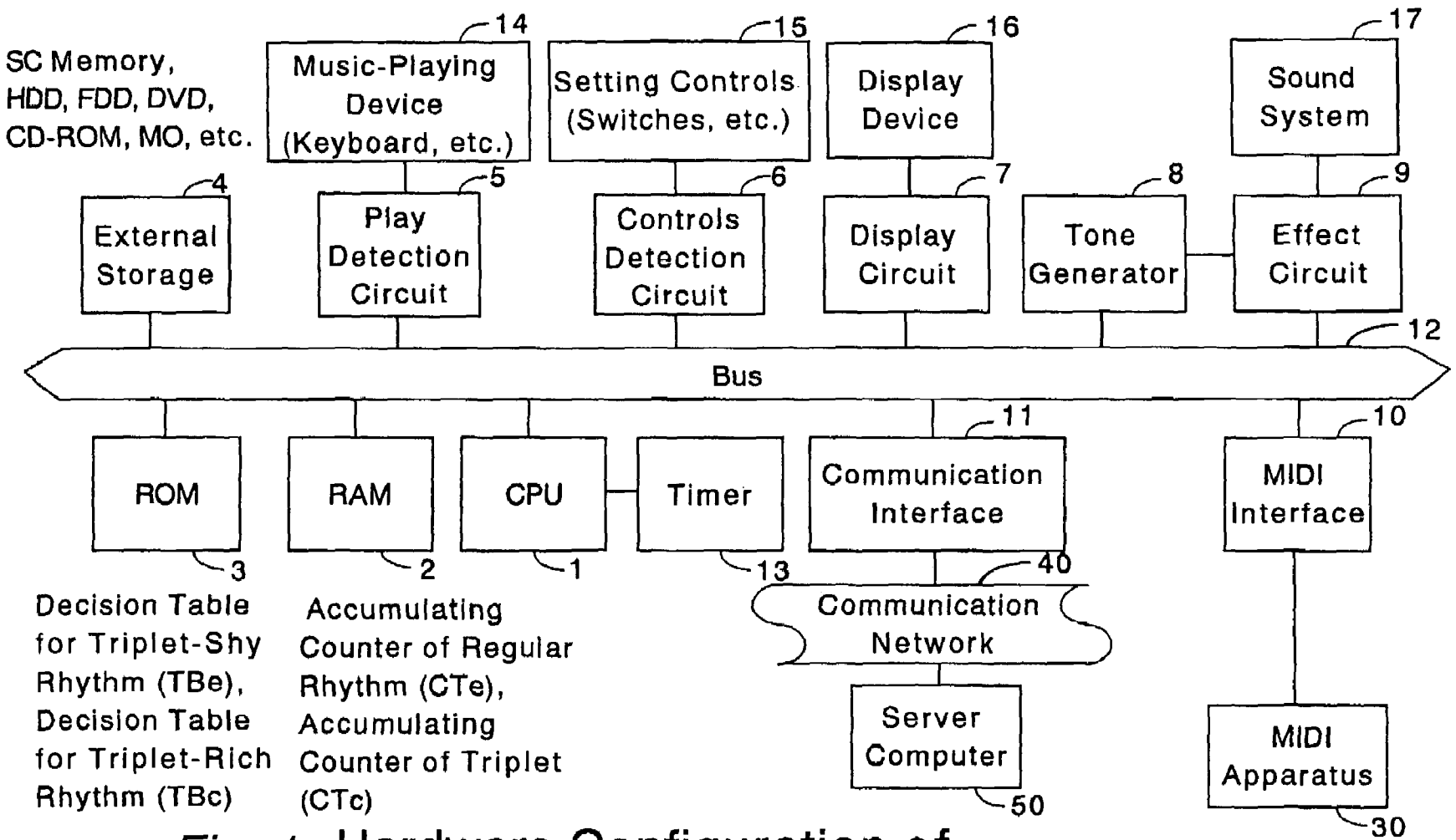
*Fig. 1* Hardware Configuration of Electronic Musical Apparatus

*Fig. 2a* Fundamental Recognition of Triplet
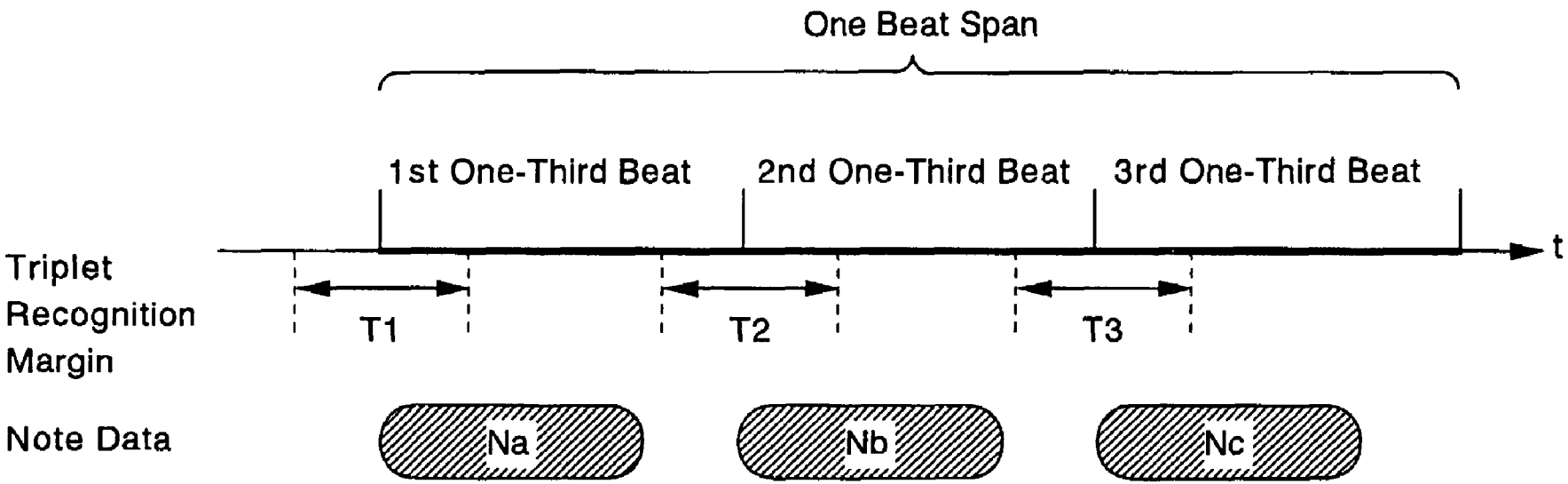

*Fig.2b* Notation of Triplet
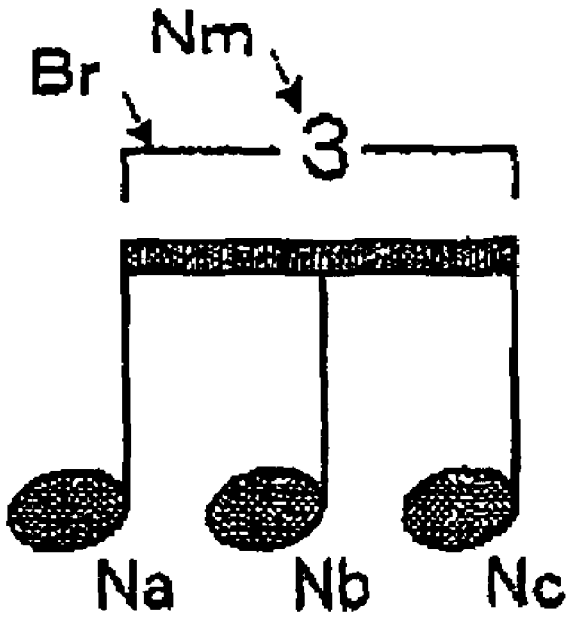

*Fig. 3a* Flexible Recognition as Regular Rhythm or Triplet Rhythm
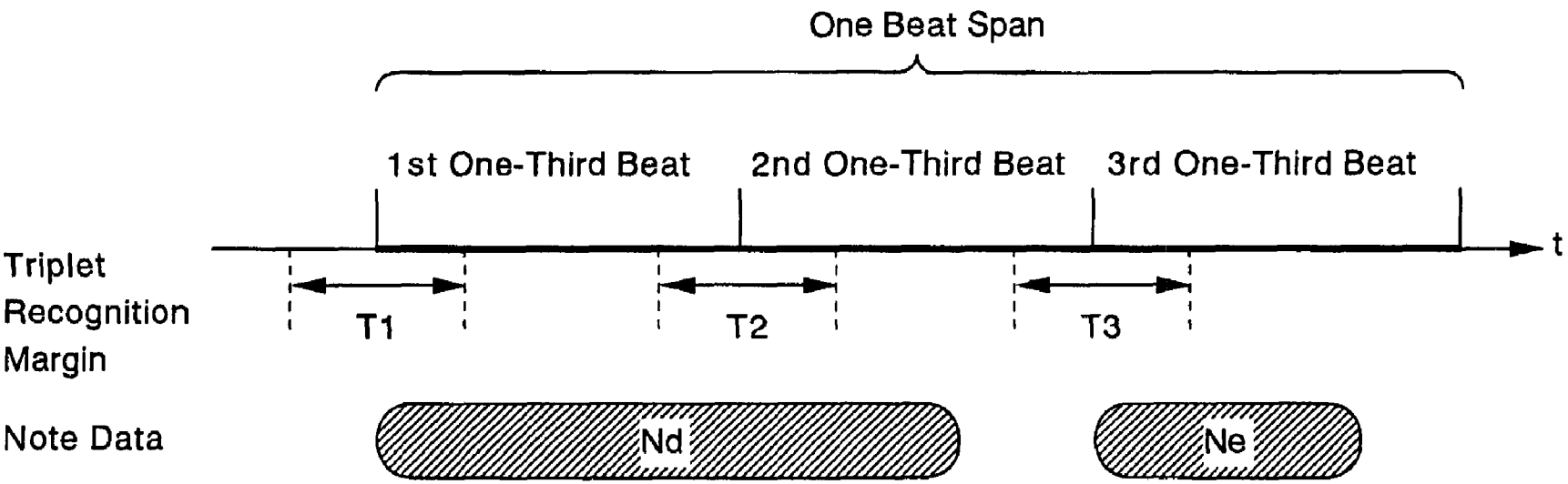

Notation as Regular Pattern Rhythm

Notation as Triplet Rhythm

*Fig. 4* Recognition Windows for Regular Rhythm and Triplet Rhythm
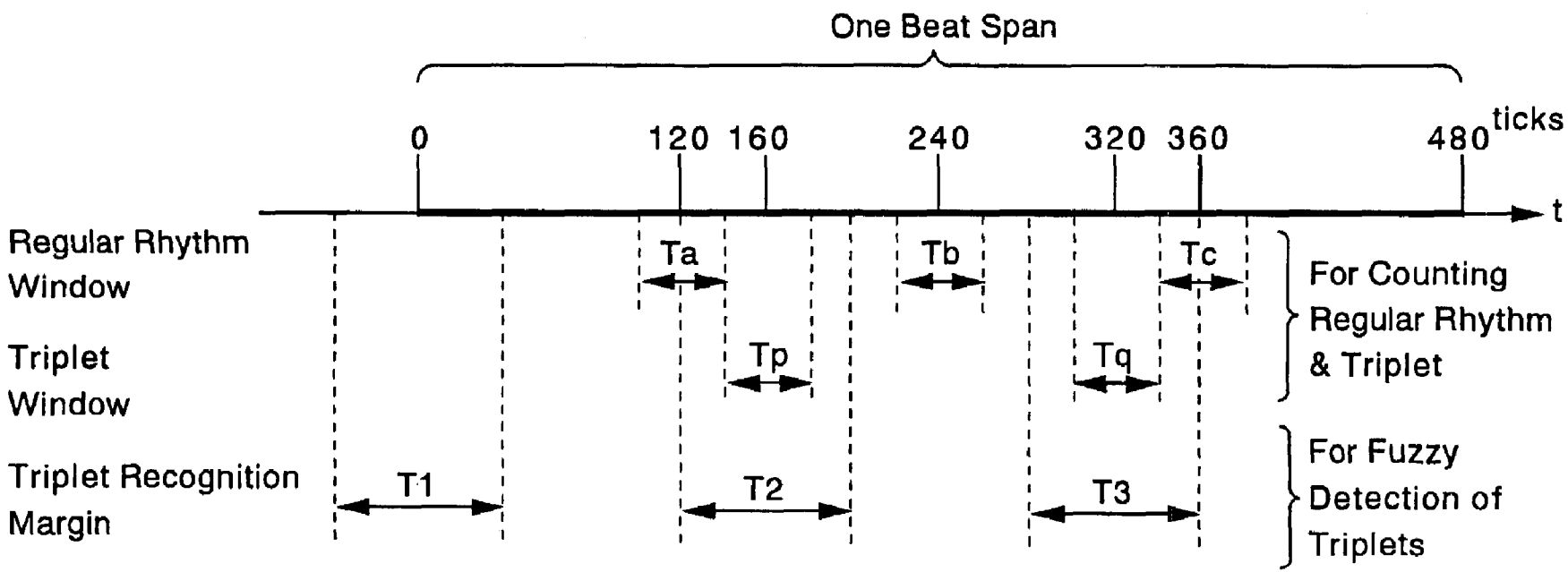

*Fig.5a* Decision Table for Triplet-Shy Rhythm TBe

| Timing Pattern to Be Checked Pt | | | Decision Jd |
|---|---|---|---|
| Note-On Exists in First Margin T1 ? | Note-On Exists in Second Margin T2 ? | Note-On Exists in Third Margin T3 ? | |
| Yes | Yes | Yes | Notate as Triplet |
| Yes | Yes | No | Notate as Regular Rhythm |
| Yes | No | Yes | Notate as Regular Rhythm |
| Yes | No | No | Notate as Regular Rhythm |
| No | Yes | Yes | Notate as Triplet |
| No | Yes | No | Notate as Regular Rhythm |
| No | No | Yes | Notate as Regular Rhythm |
| No | No | No | Notate as Regular Rhythm |

*Fig.5b* Decision Table for Triplet-Rich Rhythm TBc

| Timing Pattern to Be Checked Pt | | | Decision Jd |
|---|---|---|---|
| Note-On Exists in First Margin T1 ? | Note-On Exists in Second Margin T2 ? | Note-On Exists in Third Margin T3 ? | |
| Yes | Yes | Yes | Notate as Triplet |
| Yes | Yes | No | Notate as Triplet |
| Yes | No | Yes | Notate as Triplet |
| Yes | No | No | Notate as Triplet |
| No | Yes | Yes | Notate as Triplet |
| No | Yes | No | Notate as Triplet |
| No | No | Yes | Notate as Triplet |
| No | No | No | Notate as Regular Rhythm |

*Fig. 6* Processing for Displaying Music Score
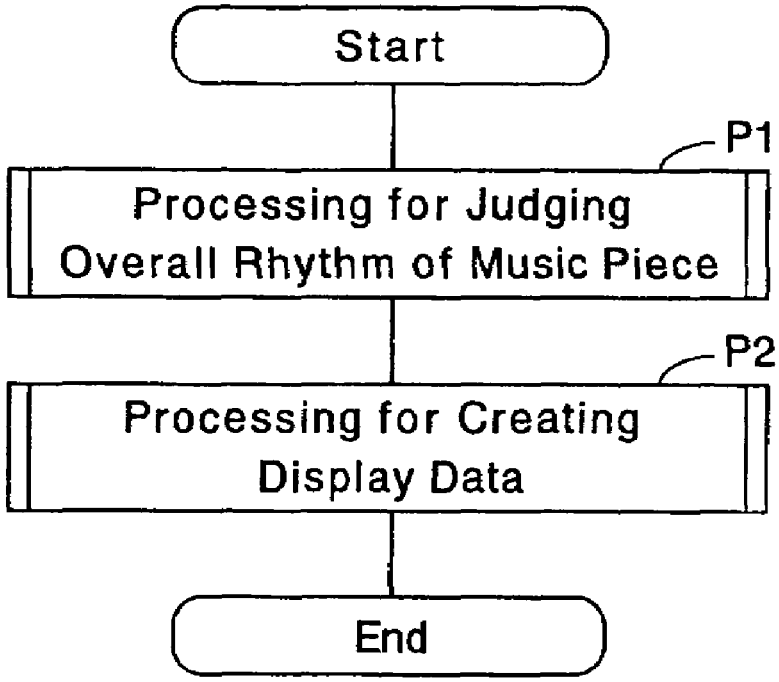

*Fig. 7a* Processing for Judging Overall Rhythm of Music Piece (Part 1)
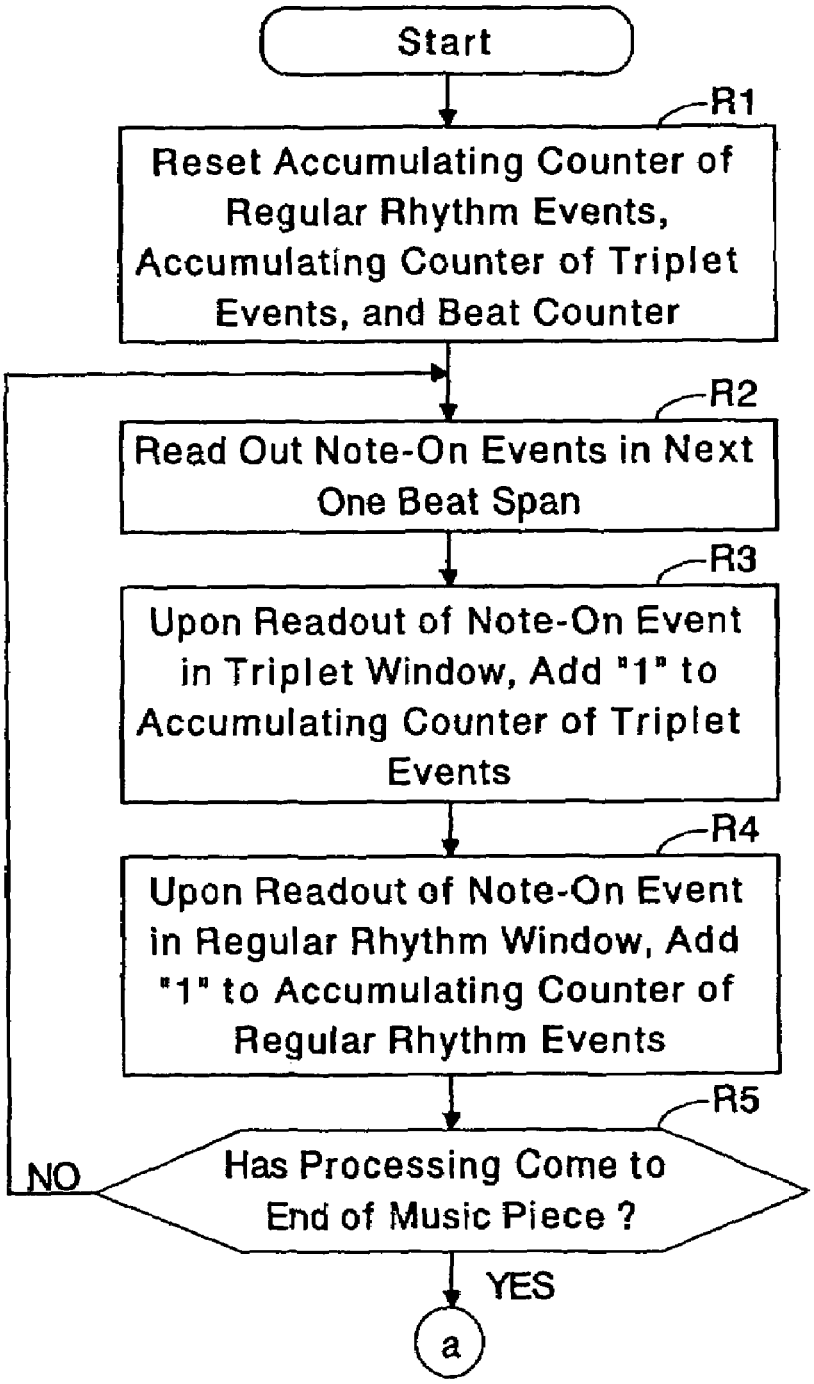

*Fig. 7b* Processing for Judging Overall Rhythm of Music Piece (Part 2)
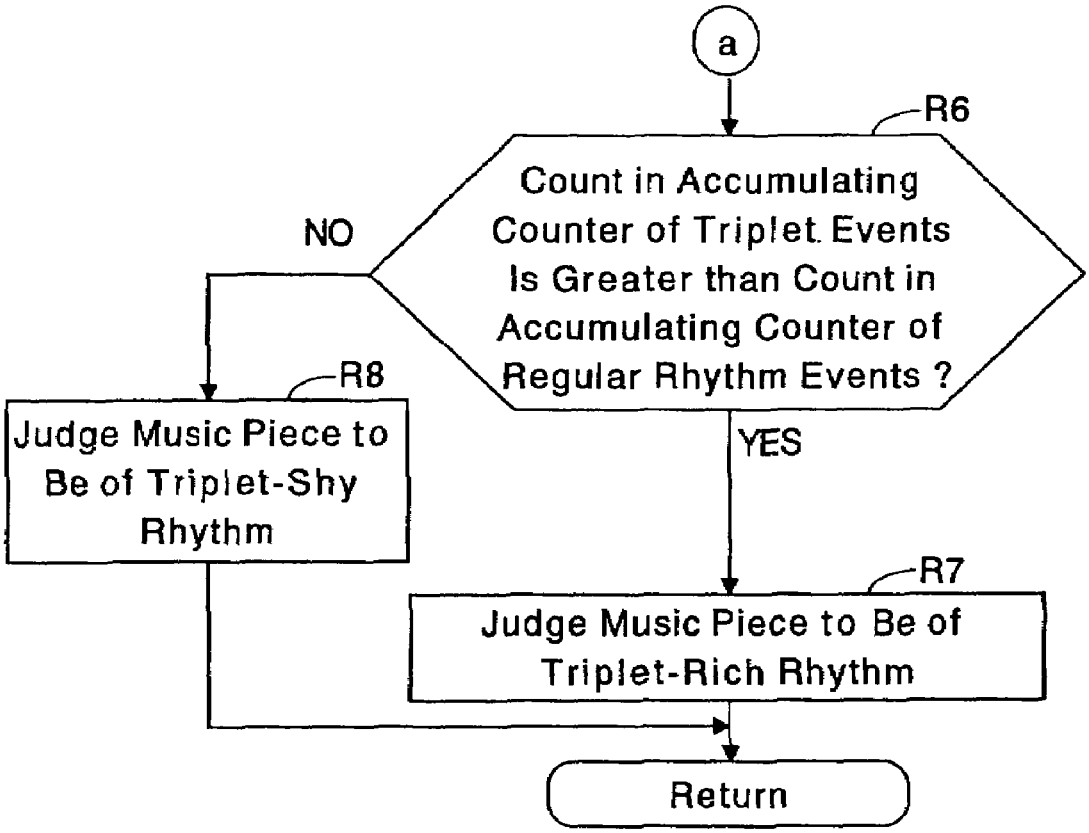

*Fig. 8a* Processing for Creating Display Data (Part 1)
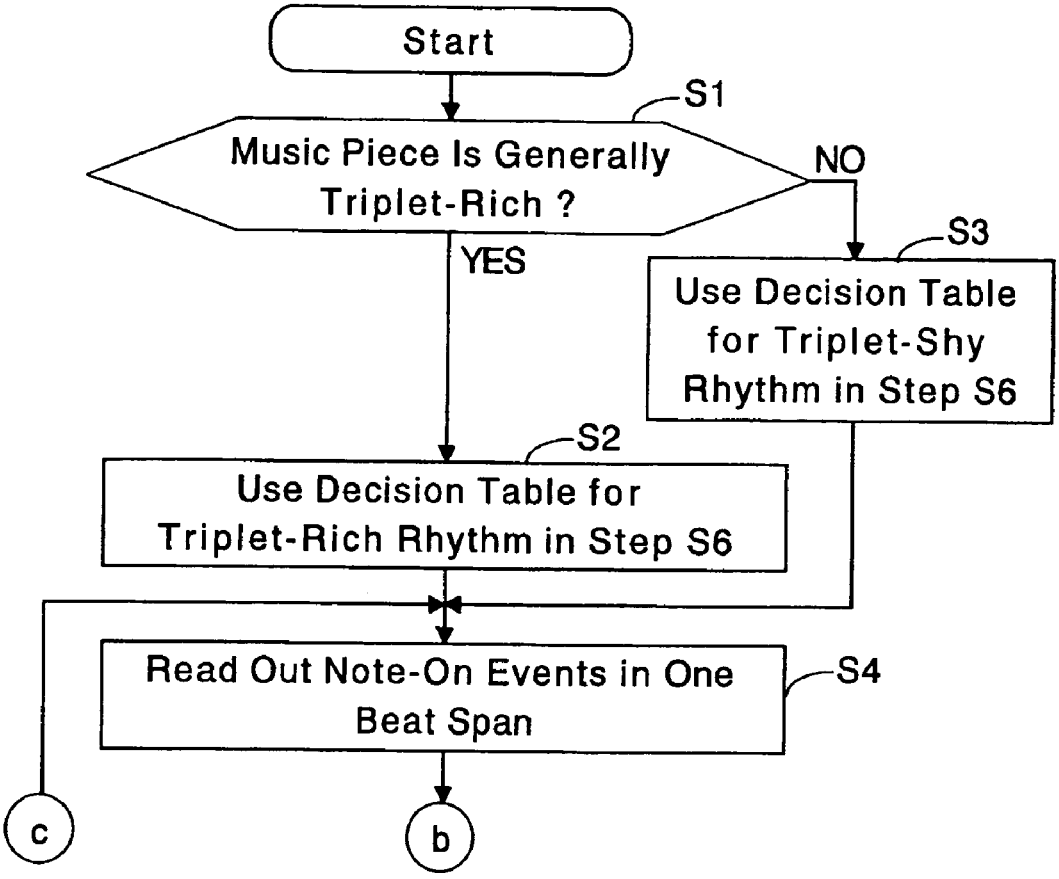

*Fig. 8b* Processing for Creating Display Data (Part 2)
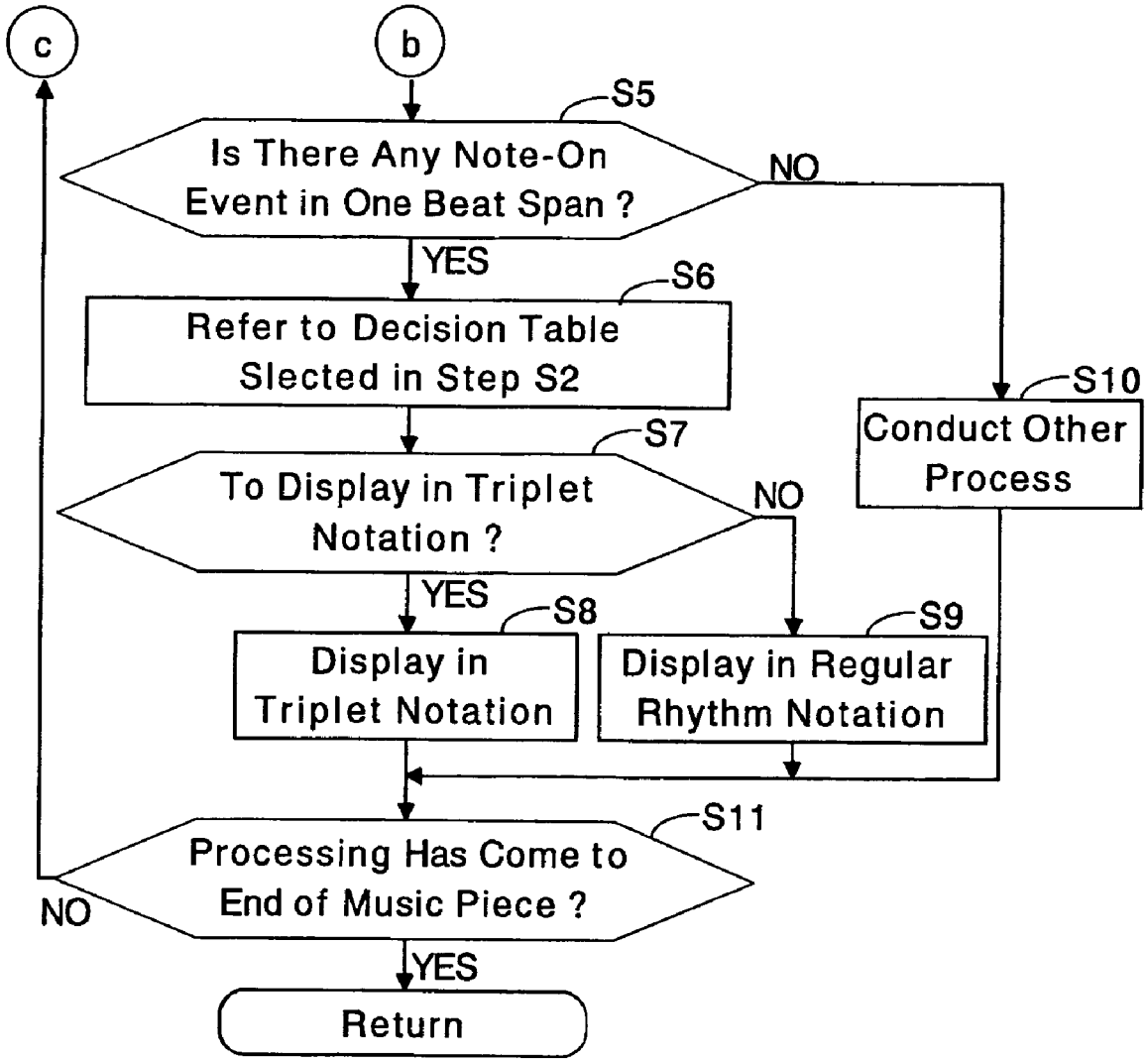

APPARATUS FOR ANALYZING MUSIC DATA AND DISPLAYING MUSIC SCORE

TECHNICAL FIELD

The present invention relates to a music data analyzing apparatus or system incorporating an arrangement for analyzing musical performance data and displaying music score with proper rhythmic presentation, and more particularly to a music data analyzing apparatus or system and a computer readable medium containing program instructions for analyzing musical performance data including tuplet-like rhythm patterns to properly decide tuplets and regular patterns in view of the general rhythm tendency of the musical performance, and for displaying a music score in properly decided tuplet notation and regular pattern notation.

BACKGROUND INFORMATION

There have been known in the art various types of musical apparatuses and methods for analyzing musical performance data and displaying music scores with properly allocated notes and other musical symbols in a good-looking and easily understandable layout. An example of such musical apparatuses is disclosed in U.S. Pat. No. 6,235,979 (and in corresponding unexamined Japanese patent publication No. H11-327,427) in which the lengths of displayed measures and the layouts of notes and other musical descriptions are properly adjusted so that the notes at different time points should be displayed without an overlap between adjacent notes or other descriptions. This patent, however, does not consider the layout of notes in connection with a rhythm which includes triplets or other tuplets in addition to regular rhythm patterns along the progression of the musical performance.

In music, the rhythm pattern is composed of a number of notes (or rests) having the same or different durations or beat lengths placed along the time axis. The standard note (or rest) durations are determined by multiplying and subdividing the duration of one beat by a factor of power of two such as twice, same, half, quarter and eighth. The regular rhythm is constituted by a combination of the standard note (or rest) durations. However, some irregular rhythm patterns are often used in music works such as by placing three notes (or rests) in a two-note span and five notes (or rests) in a four-note span, the former being used most frequently and called a triplet. The generic term for such irregular rhythm patterns is "tuplet," which is also used in this specification.

In general, a music score displaying apparatus is capable of displaying a music score of a music piece containing triplets based on musical performance data of a rhythm including triplet patterns by judging the performed note positions which fall on the timing of the triplets in the rhythmic progression of the music. An actual performance, however, may sometimes be not very exact in timing of the rhythm, and the respective time points of the notes may fluctuate or deviate from the respective theoretically exact time points along the time clock axis of the rhythm according to emotional presentations by the performer. In this connection, when a music score is displayed by a music score displaying apparatus precisely based on musical performance data (i.e. event time points) of the rhythm including triplets, a displayed music score may contain triplet patterns and regular rhythm patterns in an unintended mixture apart from the actual intention of the performer of the music piece, resulting in an unnatural and less legible appearance of the displayed (or printed) music score.

For example, in the case where three notes (with or without rests) per beat are notated in a triplet form on the musical staff, if a displayed (or printed) music score contains so many unexpected triplets, particularly a triplet consisting of less than three notes, in a music piece of a triplet-shy rhythm established on duple or quadruple meter beating, a displayed music score is apt to be rather illegible, whereas in a music piece of a triplet-rich rhythm primarily established on the beating of three notes per beat, a music score containing many triplets even consisting of less than three notes will be rather easily understandable without any visual difficulty, as the entire music is in the rhythm of three notes per beat and the music score looks consistent throughout the progression. There has never been proposed, however, an apparatus or a method which can provide good-looking and easily understandable music scores by displaying (or printing) triplets or other tuplets properly both for the music of triplet-shy rhythm and the music of triplet-rich rhythm through automatic processing of musical performance data.

SUMMARY OF THE INVENTION

It is, therefore, a primary object of the present invention to solve the above-mentioned drawbacks with the conventional apparatuses and methods, and to provide a novel type of a music data analyzing apparatus or system and a computer readable medium containing program instructions capable of analyzing musical performance data to judge whether the music is generally in a triplet-shy rhythm or in a triplet-rich rhythm and to properly modify the individual detected triplet-like patterns to be triplets or regular rhythm patterns according to the general nature of the rhythm of the music, thereby displaying a music score which is good-looking and easily understandable.

According to the present invention, the object is accomplished by providing an apparatus for analyzing music data and displaying a music score comprising: a rhythm analyzing device for analyzing music data which represents a musical performance including a rhythmic progression of note events, judging whether the musical performance is in a tuplet-shy rhythm or in a tuplet-rich rhythm, and generating rhythm judgment information which represents the judgment result; a note event detecting device for detecting note events which come at time points to be a tuplet from among the notes events; a notation form deciding device for deciding a notation form of the note events based on the detected time points and with reference to the judgment by the rhythm analyzing device, the notation form being whether in a regular rhythm pattern form or in a tuplet form; and a display device for displaying the note events in the decided notation form on a music score.

In an aspect of the present invention, the rhythm analyzing device may analyze the music data in terms of the respective time positions of the note events covering an entire length of the musical performance to generate the rhythm judgment information.

According to the present invention, the object is further accomplished by providing an apparatus for analyzing music data comprising: a time point data acquiring device for acquiring time point data contained in music data which represents a rhythmic progression of note events constituting a musical performance; an event time judging device for judging whether each of the respective event times represented by the time point data acquired by the time point data acquiring device comes within which of time windows as provided for a regular pattern rhythm category and for a tuplet rhythm category; a time event counting device for cumulatively counting the number of event times which come within the time windows for each of the rhythm categories, category by category, throughout the entire length of the musical performance; and a rhythm tendency judging device for judging whether the musical performance is in a tuplet-shy rhythm or in a tuplet-rich rhythm based on the number of event times as cumulatively counted with respect to each of the rhythm categories.

According to the present invention, the object is still further accomplished by providing a computer readable medium containing program instructions executable by a computer for causing the computer to execute: a process of analyzing music data which represents a musical performance including a rhythmic progression of note events; a process of judging whether the musical performance is in a tuplet-shy rhythm or in a tuplet-rich rhythm; a process of generating rhythm judgment information which represents the judgment result; a process of detecting note events which come at time points to be a tuplet from among the note events; a process of deciding a notation form of the note events based on the detected time points and with reference to the judgment by the rhythm analyzing device, the notation form being whether in a regular rhythm pattern form or in a tuplet form; and a process of displaying the note events in the decided notation form on a music score.

According to the present invention, the object is still further accomplished by providing a computer readable medium containing program instructions executable by a computer for causing the computer to execute: a process of acquiring time point data contained in music data which represents a rhythmic progression of note events constituting a musical performance; a process of judging whether each of the respective event times represented by the time point data acquired by the time point data acquiring device comes within which of time windows as provided for a regular pattern rhythm category and for a tuplet rhythm category; a process of cumulatively counting the number of event times which come within the time windows for each of the rhythm categories, category by category, throughout the entire length of said musical performance; and a process of judging whether the musical performance is in a tuplet-shy rhythm or in a tuplet-rich rhythm based on the number of event times as cumulatively counted with respect to each of the rhythm categories.

A music data analyzing and displaying system according to the present invention analyzes music data representing a musical performance, judges whether the musical performance is in a tuplet-shy rhythm or in a tuplet-rich rhythm, and generates rhythm judgment information representing the judgment result; detects note events which come at time points to be a tuple from among the note events in the musical performance; decides whether to notate the note events in a regular rhythm pattern form or in a tuplet form with reference to the rhythm judgment information; and displays the note events in the decided notation form on a music score. In other words, the apparatus analyzes musical performance data to judge the rhythm tendency of the entire musical performance, and flexibly decide each note events to be a tuplet or not according to the general rhythm tendency of the musical performance.

For example, some musical performances in duple meter or in quadruple meter contain a large number of triplets to make a triplet-rich rhythm which is established on the beating of three notes per beat, and some contain a small number of triplets to make a triplet-shy rhythm which is established on the beating of one, two or four (powers of two) notes per beat. From the musical performance data, note events which appear in the predetermined timing patterns (falling on the predetermined detection windows each having fuzzy margins) per predetermined detection span (e.g. a span of one beat length) can be extracted as candidate note events for triplet notation. According to the present invention, in the case where the musical performance is judged to be generally in a triplet-rich rhythm, all the candidate note events for triplet notation are to be displayed in a triplet form, whereas in the case where the musical performance is judged to be generally in a triplet-shy rhythm, the candidate note events for triplet notation which appear in the limited particular timing patterns are to be displayed in a triplet form, and the remaining candidate note events for triplet notation which appear in other patterns are to be displayed in a regular rhythm pattern. Thus, a music score of a musical performance in a triplet-rich rhythm will contain as large a number of triplets as can exist, whereas a music score of a musical performance in a triplet-shy rhythm will contain as small a number of triplets as allowed, thereby providing legible and easily understandable music scores. The term "music score" in this context means not only an entire music score for orchestra including a number of instrumental parts, but also a fraction (in terms of instrumental part, or time fragment) of such a score to any extent which represents a fragment of music progression described with notes and other notational elements of music.

As will be apparent from the above description, the present invention can be practiced not only in the form of an apparatus, but also in the form of a computer program to operate a computer or other data processing devices. The invention can further be practiced in the form of a method including the steps mentioned herein.

In addition, as will be apparent from the description herein later, some of the structural element devices of the present invention are structured by means of hardware circuits, while some are configured by a computer system performing the assigned functions according to the associated programs. The former may of course be configured by a computer system and the latter may of course be hardware structured discrete devices. Therefore, a hardware-structured device performing a certain function and a computer-configured arrangement performing the same function should be considered a same-named device or an equivalent to the other.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram illustrating the overall hardware configuration of an electronic musical apparatus embodying a system for analyzing music data and displaying music score according to the present invention;

FIGS. 2*a* and 2*b* are charts illustrating how a triplet is recognized from the musical performance data and displayed (or printed) in the musical notation according to a fundamental arrangement in the present invention;

FIGS. 3*a*-3*c* are charts illustrating an exemplary situation in which a same performed rhythm pattern can be recognized as a regular pattern rhythm and a triplet rhythm;

FIG. 4 is a chart illustrating time windows for detecting note events of regular pattern rhythm and of triplet rhythm for judging the overall rhythm tendency of a musical performance, and time windows for fuzzy detection of triplet candidates according to an embodiment of the present invention;

FIGS. 5*a* and 5*b* are tables, respectively for a musical performance in a triplet-shy rhythm and for a musical performance in a triplet-rich rhythm, to be used in deciding whether to notate the detected triplet candidate of the note events as a regular rhythm pattern or as a triplet pattern according to an embodiment of the present invention;

FIG. 6 shows a flow chart describing an example of the overall processing for analyzing musical performance data and displaying a music score according to the present invention;

FIGS. 7*a* and 7*b* show, in combination, a flow chart describing an example of the processing for judging general rhythm tendency of the musical performance as a subroutine of the step P1 of FIG. 6; and FIGS. 8*a* and 8*b* show, in combination, a flow chart describing an example of the processing for creating display data for the music score of the musical performance as a subroutine of the step P2 of FIG. 6.

DETAILED DESCRIPTION OF EMBODIMENTS OF THE INVENTION

Figure 3B:
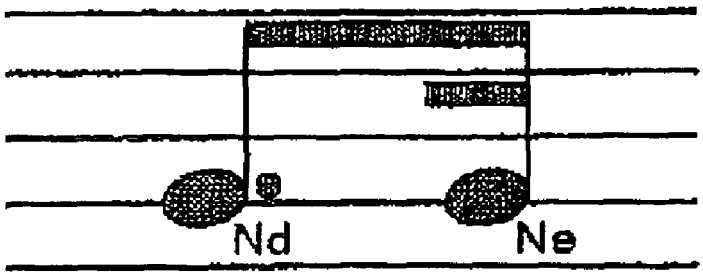

The present invention will now be described in detail with reference to the drawings showing preferred embodiments thereof. It should, however, be understood that the illustrated embodiments are merely examples for the purpose of understanding the invention, and should not be taken as limiting the scope of the invention.

Overall System Configuration

FIG. 1 shows a block diagram illustrating the overall hardware configuration of a system for analyzing musical performance data and displaying music score thereof according to an embodiment of the present invention. An electronic musical apparatus as a main setup of the system is comprised of a music data processing apparatus (computer) such as a personal computer (PC) and an electronic musical instrument having music data processing functions. In the embodiment of FIG. 1, the electronic musical apparatus comprises a central processing unit (CPU) 1, a random access memory (RAM) 2, a read-only memory (ROM) 3, an external storage device 4, a play detection circuit 5, a controls detection circuit 6, a display circuit 7, a tone generator circuit 8, an effect circuit 9, a MIDI interface 10 and a communication interface 11, all of which are connected with each other by a system bus 12.

The CPU 1 conducts various music data processing including musical information displaying processing according to a given control program utilizing a clock signal from a timer 13. The RAM 2 is used as work areas for temporarily storing various data necessary for the processing, and more particularly, memory spaces for the accumulating counter CTe of the regular rhythm events and for the accumulating counter CTc of the triplet are secured during the processing of analyzing musical performance data and displaying a music score thereof. The ROM 3 stores beforehand various control programs including the musical performance analyzing program and the music score displaying program, a decision table TBe for the triplet-shy rhythm, a decision table TBc for the triplet-rich rhythm, and music performance data for a demonstration purpose for the execution of the processing according to the present invention.

The external storage device 4 may include a built-in storage medium such as a hard disk (HD) as well as various portable external storage media such as a compact disk read-only memory (CD-ROM), a flexible disk (FD), a magneto-optical (MO) disk, a digital versatile disk (DVD), a semiconductor (SC) memory such as a small-sized memory card like Smart Media (trademark) and so forth. Thus, the electronic musical apparatus can process any of the music performance data stored in any type of external storage device 4.

The play detection circuit 5 detects the user's operations of a music-playing device 14 such as a keyboard, and the control detection circuit 6 detects the user's operations of the setting controls 15 such as key switches and a mouse device. The both detection circuits 5 and 6 introduce the data of the detected operations into the data processor mainframe. The display circuit 7 is connected to a display device 16 (including various indicators) for displaying various screen images and pictures (and various indications), and controls the displayed contents and lighting conditions of these devices according to instructions from the CPU 1, and also presents GUIs for assisting the user in operating the music-playing device 14 and various controls 15. Further, the display circuit. 7 causes the display device 16 to display a music score which includes notes in the regular rhythmic pattern form and in the triplet form on the display screen based on the musical performance data from the memory 3 or the storage 4 during the music data analyzing and music score displaying processing.

The tone generator circuit 8 generates musical tone signals as determined by the musical tone data obtained from the processing of the real-time musical performance data based on the real-time music playing operation on the music-playing device 14 or of the musical performance data read out from the memory 3 or the storage 4. The effect circuit 9 includes an effect imparting DSP (digital signal processor) and imparts intended tone effects to the musical tone signals outputted from the tone generator circuit 8. To the effect circuit 9 is connected a sound system 17, which includes a D/A converter, an amplifier and a loudspeaker, and emits audible sounds based on the effect imparted musical tone signals. When a musical performance is played back by means of the musical performance outputting (or presenting) arrangement 8, 9 and 17 in accordance with the music performance data (i.e. automatic performance data) stored in the memory 3 or the storage 4, the displaying arrangement 7 and 16 can display a music score based on the musical performance data as commanded by the user.

To the MIDI interface 10 is connected a MIDI apparatus 30 so that MIDI musical data including musical performance data are exchanged between this electronic musical apparatus and the separate or remote MIDI apparatus 30 so that the exchanged data are used in this system. The communication interface 11 is connected to a communication network CN such as the Internet and a local area network (LAN) so that control programs, reference tables, musical performance data, etc. can be received or downloaded from an external server computer 50 or the like for use in this system (and can be temporarily stored in the RAM 2 or further in the external storage 4 for later use).

While the system illustrated in FIG. 1 has in itself a music-playing function, the system of the present invention may not necessarily be equipped with a music-playing function. Then, the music playing input arrangement such as the music-playing device 14 and the play detection circuit 5, and the music playing output arrangement such as the tone generator circuit 8, the effect circuit 9 and the sound system 17 may not be provided. Further, this system may not necessarily be externally connected with the MIDI apparatus 30 and the server computer 50, and then the MIDI interface 10 and the communication interface 11 may not be provided, either.

Fundamental Concept for Tuplet Notation

In music, rhythm patterns are formed by arraying a number of notes (or rests) having the same or different values (durations) where the different note (or rest) values define different relative durations (lengths of time) as determined by subdividing the length of a measure or a beat successively into two halves, namely by the factors of power of two. The regular rhythm pattern is comprised of only such notes (or rests) of standard values. In other words, the structural elements of the rhythm pattern are the notes (or rests) having standard values obtained by dividing one measure or one beat by the factors of power of two. However, some music contain irregular rhythm patterns termed as "tuplets" which are obtained by dividing one beat (or two) duration by a factor other than the power of two, among which the "triplet" is most commonly used and is obtained by dividing one beat (or two) duration by three. The notes or rests in a triplet is notated on the music score in a particular notation for the tuplet. The present invention is to properly detect tuplets from music performance data such as MIDI data derived typically from an actual performance by a music player and display the detected tuplets in a proper notation. To begin with, the fundamental concept of the data processing of detecting and displaying triplets from the musical performance data will be described with reference to FIGS. 2*a*, 2*b* and 3*a*-3*c*.

The following embodiment will be described in connection with a triplet consisting of three one-third beats (where one-beat duration is divided into three equal durations) as a typical example of tuplets, and it should be understood that the explanation can be similarly applicable in the triplet of three four-third beats (where four-beat duration is divided into three equal durations), of three two-thirds beats (where two-beat duration is divided into three equal durations), of three sixths beats (where a half-beat duration is divided into three equal durations), or else by scaling up or down the time axis.

FIGS. 2*a* and 2*b* are charts illustrating how a triplet is recognized from the musical performance data and displayed (or printed) in the musical notation according to a fundamental arrangement in the present invention. In the case, as shown in FIG. 2*a*, where three one-third beats Na, Nb and Nc of a triplet in the musical performance start sounding respectively at the beginning of the 1st one-third beat span (i.e. the top of the one beat span), the 2nd one-third beat span and the 3rd one-third beat span, the triplet is typically notated on the music score, as shown in FIG. 2*b*, with three eighth notes Na, Nb and Nc bridged by a horizontal (or nearly horizontal) bracket Br with an indication of the number of notes Nm, which is "3" for the triplet. While the triplet shown in FIG. 2*b* is with three eighth notes beamed together, the three eighth notes may be flagged individually.

In the course of data processing, when three note events Na, Nb and Nc constitute a triplet of three notes in one beat span, the respective note-on events of the notes Na, Nb and Nc come at the respective time points of the starts of first through third one-third beat spans as viewed along the time axis t. When this situation is detected, the musical notation will be in a triplet form as shown in FIG. 2*b*.

In an actual musical performance, the notes are played with some fluctuations in the time progression, which would be typical in the case of emotional performances. Accordingly, the note-on events should be detected using detection time windows T1, T2 and T3 per beat having some margins for the recognition of triplets with respect to the theoretical time points of the starts of the respective one-third beat spans as shown in FIG. 2*a*. Thus, the fundamental method for recognizing triplets is to set these three time windows T1, T2 and T3 as triplet recognition margins and to detect the note-on events which fall in these triplet recognition margins T1, T2 and T3 from among the note events in the musical performance data, thereby recognizing the establishment of a triplet.

Figure 3C:
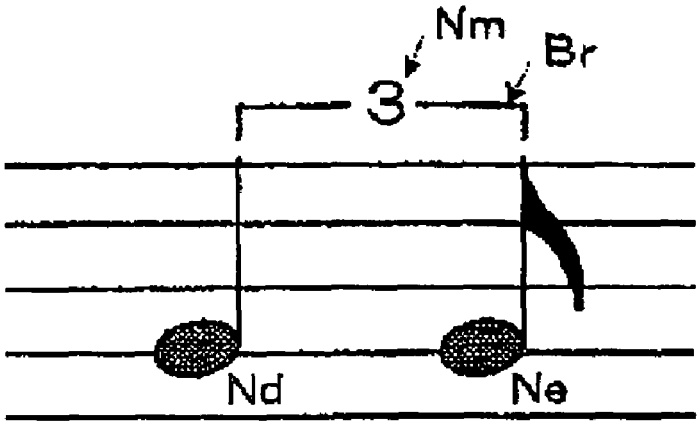

The present invention is further characterized by the provision of a scheme to judge the general rhythm tendency of the performed music piece whether the musical performance as a whole is tuplet-shy or tuplet-rich, that is triplet-shy or triplet-rich in the case of the embodiment described herein. The music piece which contains a small number of triplets and is in the rhythm established generally with regular patterns (i.e. regularly divided beats) according to the meter (duple or quadruple) of the music is called herein a music piece in the "triplet-shy rhythm." On the contrary to this, the music piece which contains a large number of triplets and is in the rhythm established generally with triplet patterns is called herein a music piece in the "triplet-rich rhythm." As in the case of FIGS. 2*a* and 2*b*, when all of the three triplet recognition margins T1-T3 detect the note-on events, it is proper to notate these three notes in the triplet form irrespective of the rhythm tendency of the music piece, that is, whether the music piece is triplet-shy or triplet-rich. However, in the case where only one or two of the triplet recognition margins T1-T3 detect the note-on events, the notational form for the detected notes had better be decided with reference to the general rhythm tendency of the music piece, that is, depending on whether the music piece is triplet-shy or triplet-rich, otherwise unnatural triplets may appear in the displayed music score. FIGS. 3*a*-3*c* are charts to explain the necessity of the flexible recognition as the regular pattern rhythm or the triplet rhythm according to the general rhythmic tendency of the music piece as a whole so that the notational form of the notes should be properly decided for the display of the music score.

In the musical performance data of a music piece in the triplet-shy rhythm, even though one or two of the triplet recognition margins T1-T3 detect a note-on event, such a note or notes will seldom be of the genuine triplet and it will not be appropriate to notate them in the triplet form pursuant to the style of FIG. 2*b*, mutatis mutandis. For example, as depicted in FIG. 3*a*, if the respective note-on events of two notes Nd and Ne in the musical performance data are detected in the first and third triplet recognition margins T1 and T3, the procedure as mentioned above with reference to FIGS. 2*a* and 2*b* will recognize the notes Nd and Ne as two notes in the triplet rhythm pattern (three counts per beat). However, in the musical performance data of a music piece in the triplet-shy rhythm, these notes Nd and Ne will very probably be two notes in the regular rhythm pattern (i.e. non-triplet pattern) and should be notated in the regular rhythm pattern as shown in FIG. 3*b* in view of the general meter (duple or quadruple) of the music piece.

On the other hand, in the musical performance data of a music piece in the triplet-rich rhythm, triplets consisting of less than three notes will appear fairly often in the rhythmic progression. In this connection, when one or two note-on events are detected by the triplet recognition margins T1-T3 according to the triplet recognizing procedure as mentioned above with reference to FIGS. 2*a* and 2*b*, these note-on events had better be recognized to be a note or notes in the triplet pattern and should be notated in the triplet form pursuant to the style of FIG. 2*b*, mutatis mutandis. For example, as depicted in FIG. 3*a*, when the respective note-on events of the notes Nd and Ne are detected in the first and third triplet recognition margins T1 and T2, these notes are preferably to be notated in the triplet rhythm pattern (three counts per beat) consisting of a quarter note and a eighth note bridged by a bracket Br with a tuplet indication numeral Nm of "3" affixed thereto as shown in FIG. 3*c*. In the music piece of the triplet-rich rhythm, there are fairly many triplet occurrences through out the rhythmic progression, and accordingly, even though triplet patterns consisting of less than three notes appear frequently in the music score, those will not be visually complex and troublesome, but rather look consistent as a whole to make the music score good-looking and easily understandable.

Thus, the inventors propose that a good-looking and easily understandable music score can be displayed (or printed) from a musical performance data file containing triplet and triplet-like note event data by first analyzing the musical performance data to judge whether the musical performance is of a triplet-shy rhythm or of a triplet-rich rhythm, then switching the triplet recognition criteria for the note event detection by the triplet recognition margins (T1-T3) in accordance with the judgment of the rhythm tendency, detecting the note events in the musical performance data using the triplet recognition margins (T1-T3), and when less than three notes (Nd and Ne) are detected by the three triplet recognition margins (T1-T3), flexibly recognizing the detected notes (Nd and Ne) to be of a non-triplet pattern or of a triplet pattern depending on the switched triplet recognition criterion and displaying the notes (Nd and Ne) in the notation of thus recognized rhythm pattern. Whether the musical performance data is of triplet-shy music or of triplet-rich music, a good-looking and easily understandable music score can be obtained with proper notation of the notes on the music score in view of the overall rhythm tendency of the music.

To summarize, the present system first analyze the musical performance data to judge whether the overall rhythm tendency of the music is triplet-shy or triplet-rich, then, depending on this judgment, switches the criteria to recognize the triplet with respect to the note event data per predetermined beat span, and displays the notes of the corresponding note events properly in the notational form for the triplet pattern and the regular rhythm pattern as recognized in accordance with the switched criteria. For example, when the note events Nd and Ne in the musical performance data come in the triplet recognition margins T1-T3, the note events Nd and Ne are taken as triplet candidate, and in the case of the music of a triplet-shy rhythm, these candidate notes Nd and Ne will be displayed in the regular rhythm pattern notation, while in the case of the music of a triplet-rich rhythm, these candidate notes Nd and Ne will be displayed in the triplet pattern notation.

Judging Rhythm Tendency and Deciding Notational Rhythm Patterns

According to an embodiment of the present invention, the rhythm tendency can be judged from the time points of the note-on events in the musical performance data according to the data processing program for analyzing the musical performance data and displaying a music score of the performed music. FIG. 4 illustrates the time windows of recognition timing for detecting note events of regular pattern rhythm and of triplet rhythm for judging the overall rhythm tendency of a musical performance, and the time windows for fuzzy detection of triplet candidates employed in the music data analyzing and music score displaying system according to an embodiment of the present invention. FIGS. 5*a* and 5*b* are tables, respectively for a musical performance in a triplet-shy rhythm and for a musical performance in a triplet-rich rhythm, to be used in deciding whether to notate the detected triplet candidate of the note events in a regular rhythm pattern notation or in a triplet notation employed in the music data analyzing and music score displaying system according to an embodiment of the present invention.

In the illustrated system, a time span which corresponds to the note (or rest) duration of one beat in the musical performance data is referred to as a "one beat span." In each one-beat span, there are provided time windows Ta-Tc, Tp and Tq of recognition timing for detecting note-on event times of regular rhythm pattern notes and of triplet notes as shown in the middle rows in FIG. 4. The time windows Ta-Tc are for detecting the existence of note events of a regular pattern rhythm and are called herein "regular rhythm windows," while the time windows Tp and Tq are for detecting the existence of note events of a triplet and are called herein "triplet windows," and these two kinds of time windows are used for judging the rhythm tendency of the performed music as to be whether triplet-shy or triplet-rich.

In the example of FIG. 4, one-beat span is divided into 480 ticks (time slot counts), wherein the regular rhythm windows Ta-Tc are defined each having a 40 ticks width respectively about the time points at 120th, 240th and 360th ticks, namely the first regular rhythm window ranges Ta=120+/−20 ticks, the second regular rhythm window ranges Tb=240+/−20 ticks and the third regular rhythm window ranges Tc=360+/−20 ticks, while the triplet windows Tp and Tq are defined each having a 40 ticks width respectively about the time points at 160th and 320th ticks, namely the first triplet window ranges Tp=160+/−20 ticks and the second triplet window ranges Tq=320+/−20 ticks. Although each of the illustrated time windows Ta-Tc, Tp and Tq has a time width of 40 ticks, the time widths of the time windows may be set longer or shorter according to necessity. As the tick count of one beat length is set to be a predetermined number ("120" in the shown case) in the described embodiment and the absolute time interval between the ticks will vary with the tempo of the musical performance accordingly, and the widths of the respective windows in terms of the absolute time will vary accordingly. As an alternative embodiment, the tick count of one beat length may be set to vary with the tempo of the musical performance, and then the widths of the respective windows in terms of the tick counts will become smaller or larger as the tompo is faster or shorter.

In order to judge whether the music piece represented by the musical performance data is of a triplet-shy rhythm or a triplet-rich rhythm, the regular rhythm windows Ta-Tc and the triplet windows Tp and Tq are set to have above-mentioned time widths, for example, in the case of musical performance data in which one beat=480 ticks, and an accumulating counter CTe of regular rhythm and an accumulating counter CTc are prepared. The musical performance data is analyzed as to existence of the note-on events of the musical performance data in any of these time windows Ta-Tc, Tp and Tq, and the number of note-on events detected in the regular rhythm windows Ta-Tc is counted by the accumulating counter CTe of regular rhythm and the number of note-on events detected in the triplet windows Tp and Tq is counted by the accumulating counter CTc of triplet. The numbers of the both counters CTe and CTc through the entire length of the musical performance data are compared with each other so that the larger count is to decide the judgment of the rhythm tendency of the musical performance.

In addition to the above-mentioned time windows, there are further provided triplet recognition margins (i.e. time windows) T1-T3 as shown in the bottom line of FIG. 4. The triplet recognition margins T1-T3 are the same ones as described with reference to FIG. 3*a* above, and each has a time width larger than the width of the time windows of Tp and Tq so that the triplet candidate events should be detected fuzzily (i.e. not very strictly). In the system are further provided two decision tables TBe and TBc which are to be used for the triplet-shy rhythm and the triplet-rich rhythm, respectively, in deciding the notational form for the fuzzily detected triplet candidate notes. Upon judgment of the general rhythm tendency of the musical performance data as described above, either one of the two decision tables TBe and TBc is selected as a look-up table for deciding the notational form of the candidate notes. The system detects any existence of note-on events in the time windows T1-T3 of the triplet recognition margins with respect to each one-beat span along the progression of the musical performance data, and handles the detected note-on events as triplet candidate notes. Then the existence pattern of the detected notes with the three time windows T1-T3 are checked in either of the tables TBe and TBc as selected above to find a decision Jd for the notational form to be employed in displaying a music score.

The triplet recognition margins T1-T3 are set to have each a time width of 80 ticks respectively centering at time points of 0 tick, 160 ticks and 320 ticks with respect to one-beat span of 480 ticks, wherein the first triplet recognition margin covers T1=0+/−40 ticks, the second triplet recognition margin covers T2=160+/−40 ticks, and the third triplet recognition margin covers T3=320+/−40 ticks. The time width of the triplet recognition margins T2-T3 may be set shorter or longer according to necessity as in the case of the time windows Ta-Tc, Tp and Tq, and will become shorter or longer according to the tempo of the musical performance data.

FIGS. 5*a* and 5*b* show specific examples of the decision tables TBe and TBc mentioned above, in which FIG. 5*a* is the decision table TBe to be used for the musical performance generally in a triplet-shy rhythm, and FIG. 5*b* is the decision table TBc to be used for the musical performance generally in a triplet-rich rhythm. Each of the tables TBe and TBc includes the relations between the timing patterns Pt consisting of the triplet candidate note-on events detected by the triplet recognition margins T1-T3 and the decisions Jd for the notation forms of the detected notes.

In the system of the embodiment herein, upon detection of the timing of the note-on events in each one-beat span by the triplet recognition margins T1-T3, the detected patterns of the note-on events in each one-beat span are compared with the timing patterns Pt in either of the decision tables TBe and TBc as selected according to the judged rhythm tendency of the musical performance under data processing to locate the coinciding timing pattern Pt, which gives a decision Jd for the notation of the detected triplet candidate notes in the one-beat span being analyzed.

More specifically, where the musical performance data is of a triplet-shy rhythm music, the decision table TBe for the triplet-shy rhythm of FIG. 5*a* gives a decision to notate the notes in a triplet form (similar to the cases of FIGS. 2*b* and 3*c*) only when the timing pattern Pt contains note-on existences in all the triplet recognition margins T1-T3 or in the last two triplet recognition margins T2 and T3 as seen in the 1st and 5th rows of the table TBe of FIG. 5*a*, and gives a decision to notate the notes in a regular rhythm pattern form (similar to the case of FIG. 3*b*).

On the other hand, where the musical performance data is of a triplet-rich rhythm music, the decision table TBc for the triplet-rich rhythm of FIG. 5*b* gives a decision to notate the notes in a triplet form (similar to the cases of FIGS. 2*b* and 3*c*) if the timing pattern Pt contains at least one note-on existence in any of the triplet recognition margins T1-T3, and gives a decision to notate any note, if any, in a regular rhythm pattern form as seen in the bottom row of the table TBc of FIG. 5*b*, as long as there is any note in the one-beat span under processing, that is outside the triplet recognition margins T1-T3.

Processing Flow for Analyzing Music Data and Displaying Music Score

FIG. 6 is a flow chart describing an example of the overall processing for analyzing musical performance data and displaying a music score according to the present invention, FIGS. 7*a* and 7*b* are, in combination, a flow chart describing an example of the processing for judging general rhythm tendency of the musical performance as a subroutine of the step P1 of FIG. 6, and FIGS. 8*a* and 8*b* are, in combination, a flow chart describing an example of the processing for creating display data for the music score of the musical performance as a subroutine of the step P2 of FIG. 6.

The processing for displaying music score of the embodiment of the present invention as illustrated in FIG. 6 starts when the user of the system designates a musical performance data file and commanding the system to display a music score of the designated musical performance data file by operating the setting controls 15 on the control panel. As the processing starts, a step P1 conducts processing for judging the overall rhythm or the general rhythm tendency of the music piece represented by the musical performance data, and then a step P2 conducts processing for creating display data. The details of the step P1 is described in the subroutine flow chart of FIGS. 7*a* and 7*b*, in which the musical performance data is analyzed and the general rhythm tendency of the music piece is judged with respect to tuplet-constituting notes based on the note event timing over the entire music progression. The details of the step P2 is described in the subroutine flow chart of FIGS. 8*a* and 8*b*, in which a decision table containing criteria for deciding the notation forms of the tuplet notes is selected to be used for the music score display, the note-on events in the musical performance data are compared with the selected table to decide the proper notation forms, and the note events are displayed on a music score in thus decided notation forms.

The processing at the step P1 (of FIG. 6) analyzes the musical performance data to judge the general rhythm tendency of the musical performance according to the procedure described in the processing for judging overall rhythm of the music piece as illustrated by the flow chart shown in FIGS. 7*a* and 7*b*. As this processing is started, a step R1 initializes the counters first by resetting to "zero" an accumulating counter CTe prepared for counting the note-on events appearing with the regular rhythm patterns in the musical performance data, an accumulating counter CTc prepared for counting the note-on events appearing with the triplet patterns in the musical performance data, and a counter of beats in the rhythm progression of the music performance. Then a step R2 reads out the note-on events existing in the next one-beat span, i.e. in beat 1 at the start of the music piece.

Next, if there is any note-on event in the triplicate window Tp or Tq, a step R3 increments the accumulating counter CTc of triplet note-on events by adding "+1" to the heretofore accumulated count value, and if there is any note-on event in the regular rhythm window Ta, Tb or Tc, a step R4 increments the accumulating counter CTe of regular rhythm note-on events by adding "+1" to the heretofore accumulated count value. After the counter accumulations at the steps R3 and R4, a step R5 checks whether the processing has come to the end of the music piece. If not (NO), the processing goes back to the step R1 to read out note-on events in the next one-beat span. The same processing from R2 through R5 is repeated until the processing comes to the end of the music piece.

When the process of reading out the music data comes to the end of the music piece, the end data of the music performance data is read out and the judgment at the step R5 turns affirmative (YES), the process flow goes forward to a step R6, which judges whether the accumulated count value in the accumulating counter CTc of the triplet note-on events is greater than the accumulated count value in the accumulating counter CTe of the regular rhythm note-on events. If the judgment at the step R6 rules that the count value of the accumulating counter CTc is greater than the count value of the accumulating counter CTe, i.e. the judgment at the step R6 is affirmative (YES), a step. R7 judges that the music piece is of a triplet-rich rhythm, in other words, the general rhythm tendency of the music piece is triplet-rich. If the judgment at the step R6 rules negative (NO), a step R8 judges that the music piece is of a triplet-shy rhythm. Upon judgment about the rhythm tendency of the music piece at either the step R7 or the step R8, the processing of judging the overall rhythm of the music piece comes to an end, and the data processing returns to the main routine of FIG. 6 and proceeds to the step P2 to start the subroutine of processing for creating display data shown in FIGS. 8*a* and 8*b*.

The processing at the step P2 (of FIG. 6) decides the notational form of the notes depending on the rhythm tendency as judged through the processing at the step P1 according to the procedure described in the processing for creating display data as illustrated by the flow chart shown in FIGS. 8*a* and 8*b*. As this processing is started, a step S1 checks whether the judgment through the preceding step P1 was that the music piece is generally triplet-rich. If the check answer at the step S1 is affirmative (YES), the process flow proceeds to a step S2, which selects to use the decision table TBc for the triplet-rich rhythm later in a step S6, while if the check answer at the step S1 is negative (NO), the process flow proceeds to a step S3, which selects to use the decision table TBe for the triplet-shy rhythm later in the step S6, before the process flow goes forward to a step S4.

Then the step S4 reads out the note-on events existing in the one-beat span to be checked, i.e. in beat 1 at the start of the music piece. A next step S5 judges whether there are any note-on events in the designated one-beat span. If there are any note-on events, i.e. the judgment at the step S5 is affirmative (YES), the note-on event pattern Pt is referred to in either decision table TBc or TBe selected in the step S2 or S3 and the decision Jd is taken out from the used decision table TBc or TB. Then the process flow goes forward to a step S7.

The step S7 checks whether the decision Jd from the utilized decision table TBc or TBe says that the notes are to be displayed in triplet notation. If the decision Jd from the table tells that there are notes to be displayed in triplet notation, the step S7 judges affirmative (YES), and the process goes to a step S8 instructs the display circuit 7 (in FIG. 1) to display the note events in the triplet notation, while if the decision Jd from the table tells that there are no notes to be displayed in triple notation, the step S7 judges negative (NO), and the process goes to a step S9 instruct the display circuit 7 to display the note events in the regular rhythm notation. If the step S5 judges there is no note-on event in the designated one-beat span (i.e. NO), the process moves forward to a step S10 to conduct other processes necessary for the music score display.

When the process through the step S8, S9 or S10 is over, the instruction to display the notes on a music score is issued to the display circuit 7 to realize the corresponding display of the music score on the display device 16. Then the process flow goes to a step S11 to check whether the processing has come to the end of the music piece. If the process has not yet come to the end, the step S11 judges negative (NO), and the process flow goes back to the step S4 to read out note-on events in the next one-beat span and, repeating the steps S4 through S11 until the data processing comes to the end of the music piece. When the readout of the musical performance data reaches its end, the step S11 judges affirmative (YES), and the processing flow returns to the main routine, ending the processing for creating the display data.

As will be understood from the above description, the present invention will provide a good-looking and easily understandable music score of both a triplet-shy rhythm or a triplet-rich rhythm, as the musical performance data is analyzed to judge whether the music piece is triplet-shy or triplet-rich, and the note events in each beat span are decided from its pattern whether to be notated in a regular rhythm pattern form or in a triplet form depending on the judged rhythm tendency.

The method for judging the rhythm tendency of the musical performance is unique in the above described embodiment of the present invention, in that respectively independent or discrete time windows Ta-Tc and Tp-Tq are used in counting the number of note-on events. The note event detection by the time windows Ta-Tc and the note event detection by the time windows Tp-Tq are separately counted to judge the rhythm tendency by comparing the count values. This idea have enabled an automatic judgment of the rhythm tendency from the musical performance data.

While the above description has been made mainly with respect to triplets among other tuplets, same technology would be applicable to other tuplets with necessary modifications by those skilled in the art. It should also be understood that the musical performance data subjected to the data processing in the present invention may be those obtained from an actual performance on an electronic musical apparatus generating MIDI output signals, or may be obtained from recorded music by means of a suitable data processing software, or may be composed by inputting the data directly. It should be further understood that the note event data may not be limited to those of the pitched notes representing a melody or the like but may be those of the unpitched notes representing a percussion beatings.

Further, the above description has been made with respect to the case in which the rhythm tendency is judged from the note event data in the musical performance data representing a music piece consisting of a single performance part which is to be displayed on a music score. But in the case of musical performance data representing a music piece consisting of a plural performance parts, the rhythm tendency may be judged from the musical performance data of a single part that is to be displayed on a music score, or may be judged from the musical performance data covering the other performance parts also.

While particular embodiments of the invention and particular modifications have been described, it should be expressly understood by those skilled in the art that the illustrated embodiments are just for preferable examples and that various modifications and substitutions may be made without departing from the spirit of the present invention so that the invention is not limited thereto, since further modifications may be made by those skilled in the art, particularly in light of the foregoing teachings. For example, the display data obtained through the process step P2 may be stored in an optional external storage 4.

It is therefore contemplated by the appended claims to cover any such modifications that incorporate those features of these improvements in the true spirit and scope of the invention.

What is claimed is:

1. An apparatus for analyzing music data and displaying music score comprising:

a rhythm analyzing device for analyzing music data which represents a musical performance including a rhythmic progression of note events, determining the total number of tuplets in said musical performance, judging whether said musical performance is in a tuplet-shy rhythm or in a tuplet-rich rhythm based on the total number of tuplets in said musical performance, and generating rhythm judgment information which represents the judgment result;

a note event detecting device for detecting note events which come at time points to be a tuplet from among said note events;

a notation form deciding device for deciding a notation form of said note events based on said detected time points and with reference to the judgment by said rhythm analyzing device, said notation form being whether in a regular rhythm pattern form or in a tuplet form; and a display device for displaying said note events in said decided notation form on a music score.

2. An apparatus for analyzing music data and displaying music score comprising:

a rhythm analyzing device for analyzing music data which represents a musical performance including a rhythmic progression of note events, judging whether said musical performance is in a tuplet-shy rhythm or in a tuplet-rich rhythm, and generating rhythm judgment information which reprents the judgment result;

a note event detecting device for detecting note events which come at time points to be a tuplet from among said note events;

a notation form deciding device for deciding a notation form of said note events based on said detected time points and with reference to the judgment by said rhythm analyzing device, said notation form being whether in a regular rhythm pattern form or in a tuplet form; and a display device for displaying said note events in said decided notation form on a music score, wherein said rhythm analyzing device analyzes the music data in terms of the respective time positions of said note events covering an entire length of said musical performance to generate said rhythm judgment information.

3. An apparatus for analyzing music data comprising:

a time point data acquiring device for acquiring time point data contained in music data which represents a rhythmic progression of note events constituting a musical performance;

an event time judging device for judging whether each of the respective event times represented by said time point data acquired by said time point data acquiring device comes within which of time windows as provided for a regular pattern rhythm category and for a tuplet rhythm category;

a time event counting device for cumulatively counting the number of event times which come within the time windows for each of said rhythm categories, category by category, throughout the entire length of said musical performance; and a rhythm tendency judging device for judging whether said musical performance is in a tuplet-shy rhythm or in a tuplet-rich rhythm based on the number of event times as cumulatively counted with respect to each of said rhythm categories.

4. A computer readable medium containing a program executable by a computer, the program containing instructions for:

analyzing music data which represents a musical performance including a rhythmic progression of note events;

determining the total number of tuplets in said musical performance;

judging whether said music performance is in a tuplet-shy rhythm or in a tuplet-rich rhythm based on the total number of tuplets in said musical performance;

generating rhythm judgment information which represents said judgment result;

detecting note events which come at time points to be a tuplet from among said note events;

deciding a notation form of said note events based on said detected time points and with reference to the judgment by said rhythm analyzing device, said notation form being whether in a regular rhythm pattern form or in a tuplet form; and displaying said note events in said decided notation form on a music score.

5. A computer readable medium containing a program executable by a computer, the program containing instructions for:

acquiring time point data contained in music data which represents a rhythmic progression of note events constituting a musical performance;

judging whether each of the respective event times represented by said time point data acquired by said time point data acquiring device comes within which of time windows as provided for a regular pattern rhythm category and for a tuplet rhythm category;

cumulatively counting the number of event times which come within the time windows for each of said rhythm categories, category by category, throughout the entire length of said musical performance;

judging whether said music performance is in a tuplet-shy rhythm or in a tuplet-rich rhythm based on the number of event times as cumulatively counted with respect to each of said rhythm categories; and outputting the judgment as to whether the music performance is in a tuplet-shy or in a tuplet-rich rhythm on a music score.

* * * * *